US009437197B2

(12) United States Patent
Honma et al.

(10) Patent No.: US 9,437,197 B2
(45) Date of Patent: Sep. 6, 2016

(54) ENCODING DEVICE, ENCODING METHOD, AND PROGRAM

(75) Inventors: Hiroyuki Honma, Chiba (JP); Toru Chinen, Kanagawa (JP); Yuki Yamamoto, Tokyo (JP); Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 153 days.

(21) Appl. No.: 14/006,148

(22) PCT Filed: Mar. 23, 2012

(86) PCT No.: PCT/JP2012/057530

§ 371 (c)(1),
(2), (4) Date: Sep. 19, 2013

(87) PCT Pub. No.: WO2012/133195

PCT Pub. Date: Oct. 4, 2012

(65) Prior Publication Data

US 2014/0006037 A1 Jan. 2, 2014
US 2014/0172433 A2 Jun. 19, 2014

(30) Foreign Application Priority Data

Mar. 31, 2011 (JP) ..... 2011-078874

(51) Int. Cl.
*G10L 19/00* (2013.01)
*G10L 21/00* (2013.01)
(Continued)

(52) U.S. Cl.
CPC ..... *G10L 19/008* (2013.01); *G10L 19/002* (2013.01); *G10L 19/24* (2013.01); *G10L 19/0204* (2013.01)

(58) Field of Classification Search
None
See application file for complete search history.

(56) References Cited

U.S. PATENT DOCUMENTS

2005/0096917 A1 5/2005 Kjorling et al.
2007/0282599 A1* 12/2007 Choo ..... G10L 19/0208 704/205

(Continued)

FOREIGN PATENT DOCUMENTS

CN 101083076 A 12/2007
CN 101548318 A 9/2009

(Continued)

OTHER PUBLICATIONS

U.S. Appl. No. 14/237,990, filed Feb. 10, 2014, Yamamoto et al.

(Continued)

*Primary Examiner* — Benny Q Tieu
*Assistant Examiner* — Sunil Chacko
(74) *Attorney, Agent, or Firm* — Wolf, Greenfield & Sacks, P.C.

(57) ABSTRACT

This technology relates to an encoding device, an encoding method, and a program capable of improving audio quality and more efficiently encoding audio. A first high-frequency encoding circuit encodes a high-frequency range based on a low-frequency subband signal and a high-frequency subband signal and obtains a high-frequency code amount. A low-frequency encoding circuit encodes a low-frequency signal with a code amount determined by the high-frequency code amount and a low-frequency decoding circuit decodes the encoded low-frequency signal. A subband dividing circuit divides a decoded low-frequency signal obtained by decoding into decoded low-frequency subband signals of a plurality of subbands and a second high-frequency encoding circuit generates a high-frequency code string such that a code amount of the high-frequency code string for obtaining a high-frequency component is not larger than the high-frequency code amount based on the decoded low-frequency subband signals and the high-frequency subband signals. The present invention is applicable to the encoding device.

6 Claims, 8 Drawing Sheets

(51) Int. Cl.

| | |
|---|---|
| ***G10L 19/008*** | (2013.01) |
| ***G10L 19/002*** | (2013.01) |
| ***G10L 19/24*** | (2013.01) |
| *G10L 19/02* | (2013.01) |

(56) References Cited

U.S. PATENT DOCUMENTS

| | | | |
|---|---|---|---|
| 2007/0299656 | A1 | 12/2007 | Son et al. |
| 2009/0192792 | A1 | 7/2009 | Lee et al. |
| 2010/0017198 | A1 | 1/2010 | Yamanashi et al. |
| 2012/0243526 | A1 | 9/2012 | Yamamoto et al. |
| 2013/0028427 | A1 | 1/2013 | Yamamoto et al. |
| 2013/0202118 | A1 | 8/2013 | Yamamoto et al. |
| 2014/0200899 | A1 | 7/2014 | Yamamoto et al. |
| 2014/0200900 | A1 | 7/2014 | Yamamoto et al. |
| 2014/0205101 | A1 | 7/2014 | Yamamoto et al. |

FOREIGN PATENT DOCUMENTS

| | | | |
|---|---|---|---|
| CN | 101853663 | A | 10/2010 |
| CN | 101896968 | A | 11/2010 |
| JP | 08-030295 | | 2/1996 |
| JP | 2007-171821 | | 7/2007 |
| JP | 2008-107415 | | 5/2008 |
| JP | 2008-139844 | | 6/2008 |
| JP | 2008-224902 | | 9/2008 |
| WO | WO 2007/129728 | A1 | 11/2007 |
| WO | WO 2007/142434 | A1 | 12/2007 |
| WO | WO 2009/059631 | A1 | 5/2009 |

OTHER PUBLICATIONS

U.S. Appl. No. 14/236,350, filed Jan. 31, 2014, Yamamoto et al.

U.S. Appl. No. 14/237,993, filed Feb. 10, 2014, Yamamoto et al.

U.S. Appl. No. 13/640,500, filed Apr. 19, 2013, Yamamoto et al.

U.S. Appl. No. 13/639,325, filed Oct. 4, 2012, Yamamoto et al.

U.S. Appl. No. 13/499,559, filed Jun. 11, 2012, Yamamoto et al.

Krishnan et al., EVRC-Wideband: The New 3GPP2 Wideband Vocoder Standard, Qualcomm Inc., IEEE International Conference on Acoustics, Speech, and Signal Processing, Apr. 15, 2007, pp. II-333-II-336.

* cited by examiner

ENCODING DEVICE, ENCODING METHOD, AND PROGRAM

CROSS REFERENCE TO RELATED APPLICATIONS

This is a U.S. National Stage Application under 35 U.S.C. §371, based on International Application No. PCT/JP2012/057530, filed Mar. 23, 2012, which claims priority to Japanese Patent Application JP 2011-078874, filed Mar. 31, 2011, each of which is hereby incorporated by reference in its entirety.

TECHNICAL FIELD

This technology relates to an encoding device, an encoding method, and a program and especially relates to the encoding device, the encoding method, and the program capable of improving audio quality and more efficiently encoding audio.

BACKGROUND ART

Conventionally, HE-AAC (high efficiency MPEG (moving picture experts group) 4 AAC (advanced audio coding)) (ISO/IEC14496-3) is known as an encoding method of an audio signal.

In this encoding method, characteristic information is extracted from a high-frequency signal component to be encoded together with a low-frequency signal component (refer to Patent Document 1, for example). At the time of decoding, the low-frequency signal component is mapped to a high-frequency range and a frequency envelope is adjusted based on the information of the high-frequency range included in a code string. In such encoding method, only the characteristic information of the high-frequency signal component is encoded as information regarding the high-frequency signal component, so that it is possible to improve coding efficiency while inhibiting deterioration in audio quality.

In general, in the encoding device which adopts an encoding system to encode only the characteristic information of the high-frequency range as the information regarding the high-frequency component, there often is a case in which a code amount of the high-frequency range is extremely smaller than that of a low-frequency range and adjusting flexibility of the code amount of the high-frequency range is small. Therefore, a method is such that the information regarding the high-frequency signal component is first encoded and then the low-frequency signal component is encoded with a remaining code amount. Such a configuration may avoid a complicated configuration of the encoding device and prevent a large calculation amount.

CITATION LIST

Patent Document

Patent Document 1: Japanese Patent Application Laid-Open No. 2008-139844

SUMMARY OF THE INVENTION

Problems To Be Solved By the Invention

However, the above-described technology cannot encode the audio fully efficiently while improving the audio quality. Specifically, the code amount of the code string of the low-frequency signal component and the code amount of the characteristic information of the high-frequency range cannot be appropriately controlled at the time of the encoding, for example.

This technology is achieved in view of such a situation and an object thereof is to improve the audio quality and more efficiently encode the audio.

Solutions To Problems

An encoding device according to one aspect of this technology includes a first high-frequency encoding unit which calculates a high-frequency code amount being a code amount of a high-frequency code string for obtaining a high-frequency component based on a low-frequency component and the high-frequency component of an input signal, a low-frequency encoding unit which encodes the low-frequency component of the input signal to generate a low-frequency code string, a low-frequency decoding unit which decodes the low-frequency code string, a second high-frequency encoding unit which generates the high-frequency code string based on a decoded low-frequency component obtained by decoding the low-frequency code string and the high-frequency component such that the code amount of the high-frequency code string is not larger than the high-frequency code amount, and a multiplexing unit which multiplexes the low-frequency code string and the high-frequency code string to generate an output code string.

It is possible to allow the first high-frequency encoding unit to calculate the high-frequency code amount based on low-frequency subband signals of a plurality of subbands composing the low-frequency component and high-frequency subband signals of a plurality of subbands composing the high-frequency component and allow the second high-frequency encoding unit to generate the high-frequency code string based on decoded low-frequency subband signals of a plurality of subbands composing the decoded low-frequency component and the high-frequency subband signals.

The encoding device may further include a delay unit which delays the high-frequency code amount, the decoded low-frequency component, and the high-frequency component input to the second high-frequency encoding unit.

The encoding device may further include a code amount adjusting unit which makes a difference between the code amount of the high-frequency code string and the high-frequency code amount a surplus code amount capable of being used in subsequent processes and controls storage of the surplus code amount, when the code amount of the high-frequency code string obtained by the second high-frequency encoding unit is smaller than the high-frequency code amount.

The surplus code amount may be used for adjusting the code amount of at least any of the high-frequency code string and the low-frequency code string.

An encoding method or a program according to one aspect of this technology includes the steps of calculating a high-frequency code amount being a code amount of a high-frequency code string for obtaining a high-frequency component based on a low-frequency component and the high-frequency component of an input signal, encoding the low-frequency component of the input signal to generate a low-frequency code string, decoding the low-frequency code string, generating the high-frequency code string based on a decoded low-frequency component obtained by decoding the low-frequency code string and the high-frequency component such that the code amount of the high-frequency code string is not larger than the high-frequency code amount, and multiplexing the low-frequency code string and the high-frequency code string to generate an output code string.

According to one aspect of this technology, the high-frequency code amount being the code amount of the high-frequency code string for obtaining the high-frequency component is calculated based on the low-frequency component and the high-frequency component of the input signal, the low-frequency component of the input signal is encoded and the low-frequency code string is generated, the low-frequency code string is decoded, the high-frequency code string is generated based on the decoded low-frequency component obtained by decoding the low-frequency code string and the high-frequency component such that the code amount of the high-frequency code string is not larger than the high-frequency code amount, and the low-frequency code string and the high-frequency code string are multiplexed to generate the output code string.

Effects of the Invention

According to one aspect of this technology, it is possible to improve the audio quality and more efficiently encode the audio.

MODE FOR CARRYING OUT THE INVENTION

Embodiments to which this technology is applied are hereinafter described with reference to the drawings.

First Embodiment

Configuration Example of Encoding Device

Figure 1:
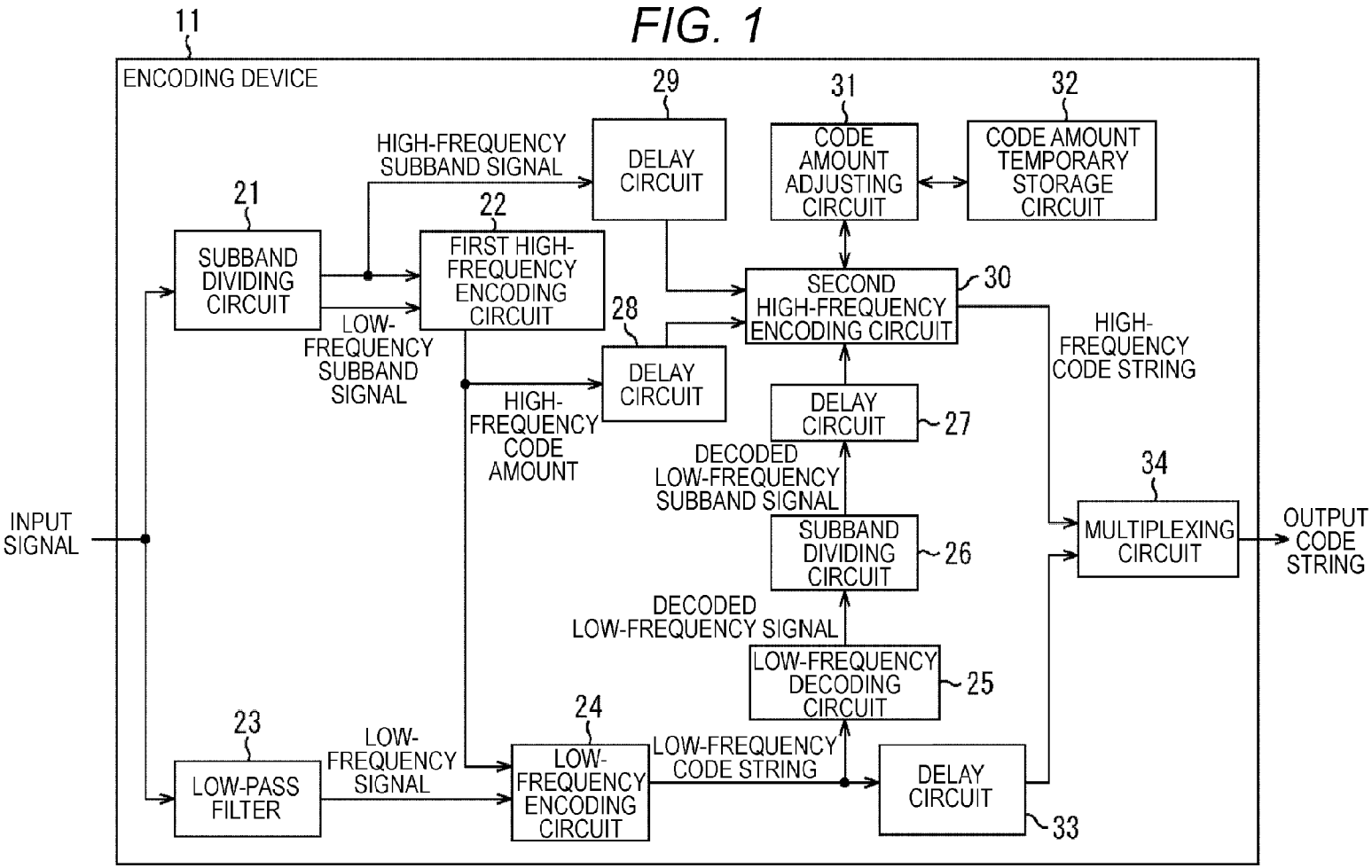
FIG. 1 is a view illustrating a configuration example of one embodiment of an encoding device.

FIG. 1 is a view illustrating a configuration example of one embodiment of an encoding device to which this technology is applied.

An encoding device 11 encodes an input signal being an audio signal and outputs an output code string obtained as a result.

The encoding device 11 is composed of a subband dividing circuit 21, a first high-frequency encoding circuit 22, a low-pass filter 23, a low-frequency encoding circuit 24, a low-frequency decoding circuit 25, a subband dividing circuit 26, a delay circuit 27, a delay circuit 28, a delay circuit 29, a second high-frequency encoding circuit 30, a code amount adjusting circuit 31, a code amount temporary storage circuit 32, a delay circuit 33, and a multiplexing circuit 34.

The subband dividing circuit 21 divides the input signal into a plurality of subband signals, supplies an obtained low-frequency subband signal to the first high-frequency encoding circuit 22 and supplies a high-frequency subband signal to the first high-frequency encoding circuit 22 and the delay circuit 29.

For example, a frequency band of an entire input signal is divided into a plurality of frequency bands having the same band width (hereinafter, referred to as subbands) and the input signal is divided into signals of the subbands (hereinafter, referred to as the subband signals). Out of the subband signals, the subband signal of a predetermined subband on a high-frequency side is made the high-frequency subband signal and the subband signal of a predetermined subband on a low-frequency side whose frequency is lower than that of the high-frequency side is made the low-frequency subband signal.

The first high-frequency encoding circuit 22 encodes an estimation coefficient used for estimating power of the high-frequency subband signal based on a feature amount obtained from the low-frequency subband signal supplied from the subband dividing circuit 21 and supplies a code amount (hereinafter, referred to as a high-frequency code amount) to the low-frequency encoding circuit 24 and the delay circuit 28.

The low-pass filter 23 filters the input signal supplied thereto and supplies a low-frequency signal being a low-frequency component of the input signal obtained as a result to the low-frequency encoding circuit 24. The low-frequency signal is the signal formed of the low-frequency subband signals on the low-frequency side.

The low-frequency encoding circuit 24 encodes the low-frequency signal from the low-pass filter 23 with a code amount obtained by subtracting the high-frequency code amount supplied from the first high-frequency encoding circuit 22 from a code amount available in a processing frame of the input signal. The low-frequency encoding circuit 24 supplies a low-frequency code string obtained by encoding the low-frequency signal to the low-frequency decoding circuit 25 and the delay circuit 33.

The low-frequency decoding circuit 25 decodes the low-frequency code string supplied from the low-frequency encoding circuit 24 and supplies a decoded low-frequency signal obtained as a result to the subband dividing circuit 26. The subband dividing circuit 26 divides the decoded low-frequency signal supplied from the low-frequency decoding circuit 25 into subband signals of a plurality of subbands on the low-frequency side (hereinafter, referred to as decoded low-frequency subband signals) and supplies the same to the delay circuit 27. Herein, frequency bands of the subbands of the decoded low-frequency subband signals are the same as those of the subbands of the low-frequency subband signals.

The delay circuit 27 delays the decoded low-frequency subband signal from the subband dividing circuit 26 to supply to the second high-frequency encoding circuit 30. The delay circuit 28 delays the high-frequency code amount from the first high-frequency encoding circuit 22 by a certain processing frame to supply to the second high-frequency encoding circuit 30. The delay circuit 29 delays the high-frequency subband signal from the subband dividing circuit 21 to supply to the second high-frequency encoding circuit 30.

The second high-frequency encoding circuit 30 encodes the estimation coefficient of the power of the high-frequency subband signal from the delay circuit 29 such that the code amount is not larger than that determined by the high-frequency code amount obtained by the delay circuit 28 based on the feature amount obtained from the decoded low-frequency subband signal output from the delay circuit 27. The second high-frequency encoding circuit 30 supplies a high-frequency code string obtained by encoding the estimation coefficient to the multiplexing circuit 34 and supplies the high-frequency code amount of the high-frequency code string to the code amount adjusting circuit 31.

When the high-frequency code amount obtained by the second high-frequency encoding circuit 30 is smaller than the high-frequency code amount of the first high-frequency encoding circuit 22 obtained through the delay circuit 28, the code amount adjusting circuit 31 supplies a surplus code amount to the code amount temporary storage circuit 32. The code amount temporary storage circuit 32 stores the surplus code amount. The surplus code amount is appropriately used in subsequent processing frames.

The delay circuit 33 delays the low-frequency code string obtained by the low-frequency encoding circuit 24 by a certain processing frame to supply to the multiplexing circuit 34. The multiplexing circuit 34 multiplexes the low-frequency code string from the delay circuit 33 and the high-frequency code string from the second high-frequency encoding circuit 30 and outputs the output code string obtained as a result.

Improvement In Audio Quality

In an encoding system in the encoding device 11 and the encoding system such as HE-AAC, characteristic information of a high-frequency component of the audio signal is encoded with an extremely small code amount and a large part of the code amount is assigned to a low-frequency range being the frequency band in which distortion is easily acoustically perceived by human. The encoding device 11 actively adjusts the code amount according to a state of the signal of the high-frequency component, so that the high-frequency code amount often varies significantly according to the processing frame.

For such a reason, the above-described encoding system has a general configuration in which the high-frequency signal is first and then the low-frequency signal is encoded with a remaining code amount.

On the other hand, in an encoding method of encoding the high-frequency component using the low-frequency component, the fact that the low-frequency signal handled by the encoding device 11 and the low-frequency signal handled by a decoding device are different from each other is a cause of deterioration in audio quality of the high-frequency signal.

Figure 2:
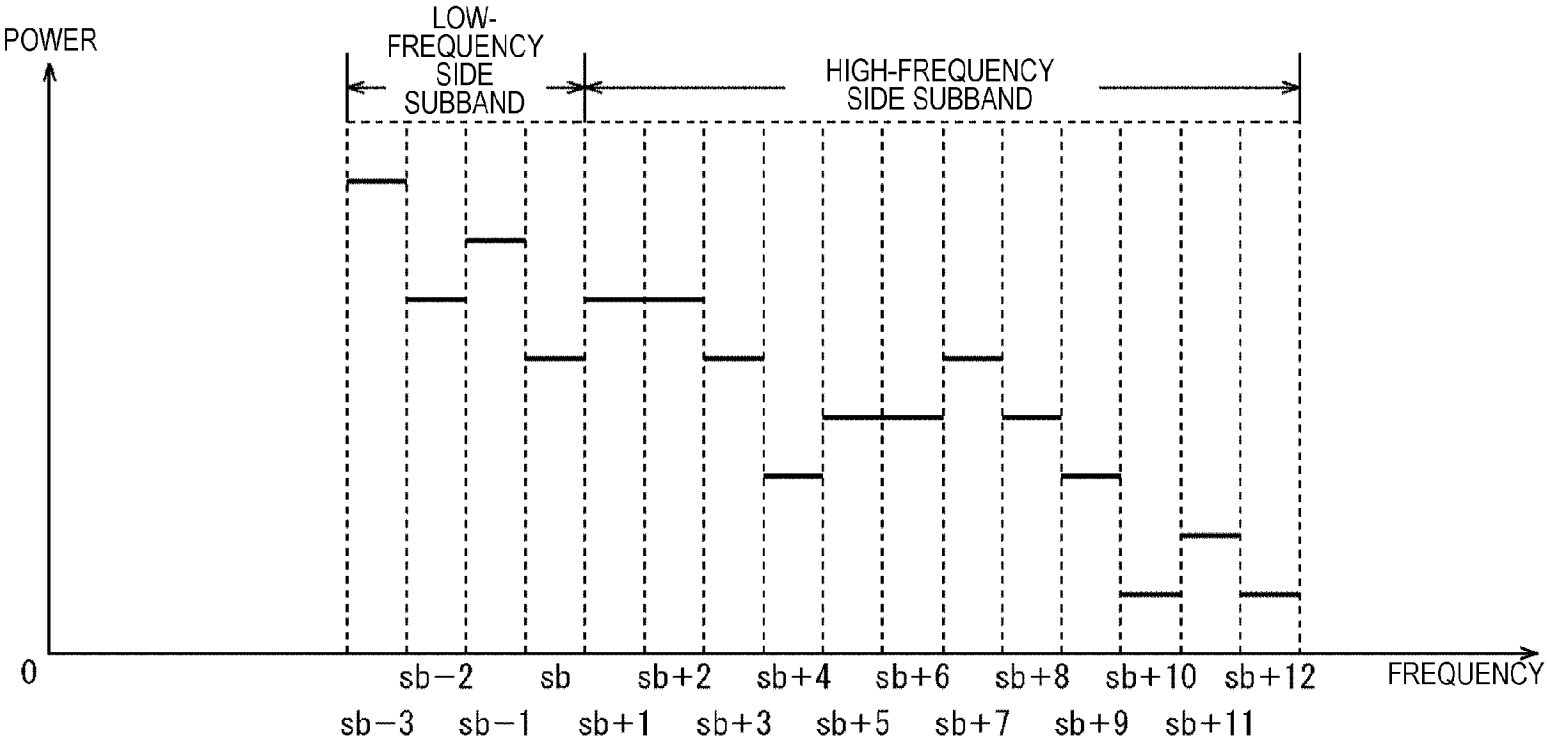
FIG. 2 is a view illustrating power of each subband of an input signal.

That is to say, suppose that the input signal is divided into the low-frequency subbands and the high-frequency subbands by subband division of the input signal as illustrated in FIG. 2, for example. Meanwhile, FIG. 2 illustrates power of each subband of the input signal. In the drawing, a frequency is plotted along the abscissa and the power of the subband signal of each subband is plotted along the ordinate.

In an example in FIG. 2, the low-frequency component of the input signal is divided into 4 subbands which are subbands sb−3 to sb, and the high-frequency component of the input signal is divided into 12 subbands which are subbands sb+1 to sb+12. The subband adjacent to a high-frequency side of the subband sb whose frequency is the highest on the low-frequency side is made the subband sb+1 whose frequency is the lowest on the high-frequency side.

Herein, in the drawing of each subband, a solid line in a transverse direction indicates the power of the subband signal (low-frequency subband signal or high-frequency subband signal) of the subband.

Suppose that the low-frequency component of such input signal is encoded and the low-frequency code string obtained by the encoding is decoded by the decoding device. In this case, when the subband division of the decoded low-frequency signal obtained by decoding the low-frequency code string is performed, the decoded low-frequency signal is divided into four subbands which are the subbands sb−3 to sb, as illustrated in FIG. 3, for example.

Figure 3:
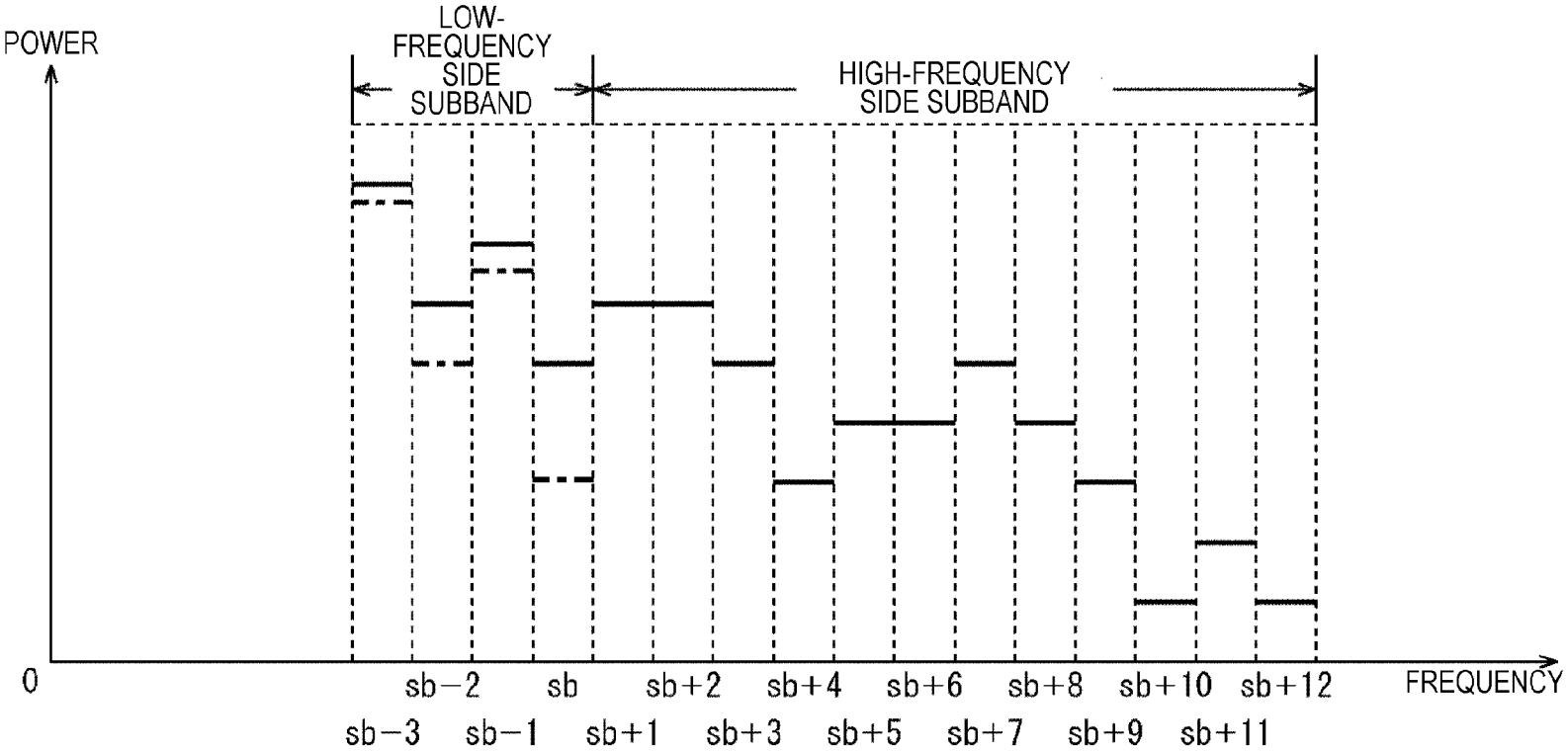
FIG. 3 is a view illustrating the power of each subband of the input signal and a decoded low-frequency signal.

Meanwhile, in FIG. 3, the frequency is plotted along the abscissa and the power of the subband signal of each subband is plotted along the ordinate. Also, the solid line in the transverse direction of each subband indicates the power of each subband signal before the encoding of the input signal and a dashed-dotted line in the transverse direction of each subband indicates the power of the decoded low-frequency subband signal forming the decoded low-frequency signal obtained by the decoding device.

As illustrated in FIG. 3, the decoded low-frequency signal obtained by the decoding device includes an encoding error, so that, the power of the decoded low-frequency subband signal is different from the power of the low-frequency subband signal in the encoding device 11 as a result.

Therefore, when the estimation coefficient with which it is possible to estimate the power of the high-frequency subband signal with the highest degree of accuracy is selected from a plurality of estimation coefficients from the feature amount and the high-frequency subband signal using the power of the low-frequency subband signal as the feature amount, for example, and this is output to the decoding device, the audio quality might be deteriorated.

That is to say, on the encoding side, the power of the high-frequency subband signal is estimated using the low-frequency subband signal different from the decoded low-frequency subband signal obtained by the decoding device, the high-frequency subband signal, and the estimation coefficient and the most appropriate estimation coefficient is selected from an estimated result. Therefore, when the estimation coefficient selected in this manner is used, it is not always possible to estimate the power of the high-frequency subband signal with a high degree of accuracy if the low-frequency component used for estimating the power of the high-frequency subband signal is different between the encoding side and the decoding side.

Therefore, in order to improve the audio quality by performing more accurate estimation, it is necessary that the decoding device which decodes the low-frequency code string is embedded also in the encoding device and that a high-frequency range is encoded using the decoded low-frequency signal obtained thereby.

The encoding device 11 is provided with the low-frequency decoding circuit 25 which decodes the low-frequency code string, and this encodes the high-frequency range using the decoded low-frequency subband signal obtained by the low-frequency decoding circuit 25, so that it is possible to improve the quality of the audio obtained by the decoding.

Description of Encoding Process

Figure 4:
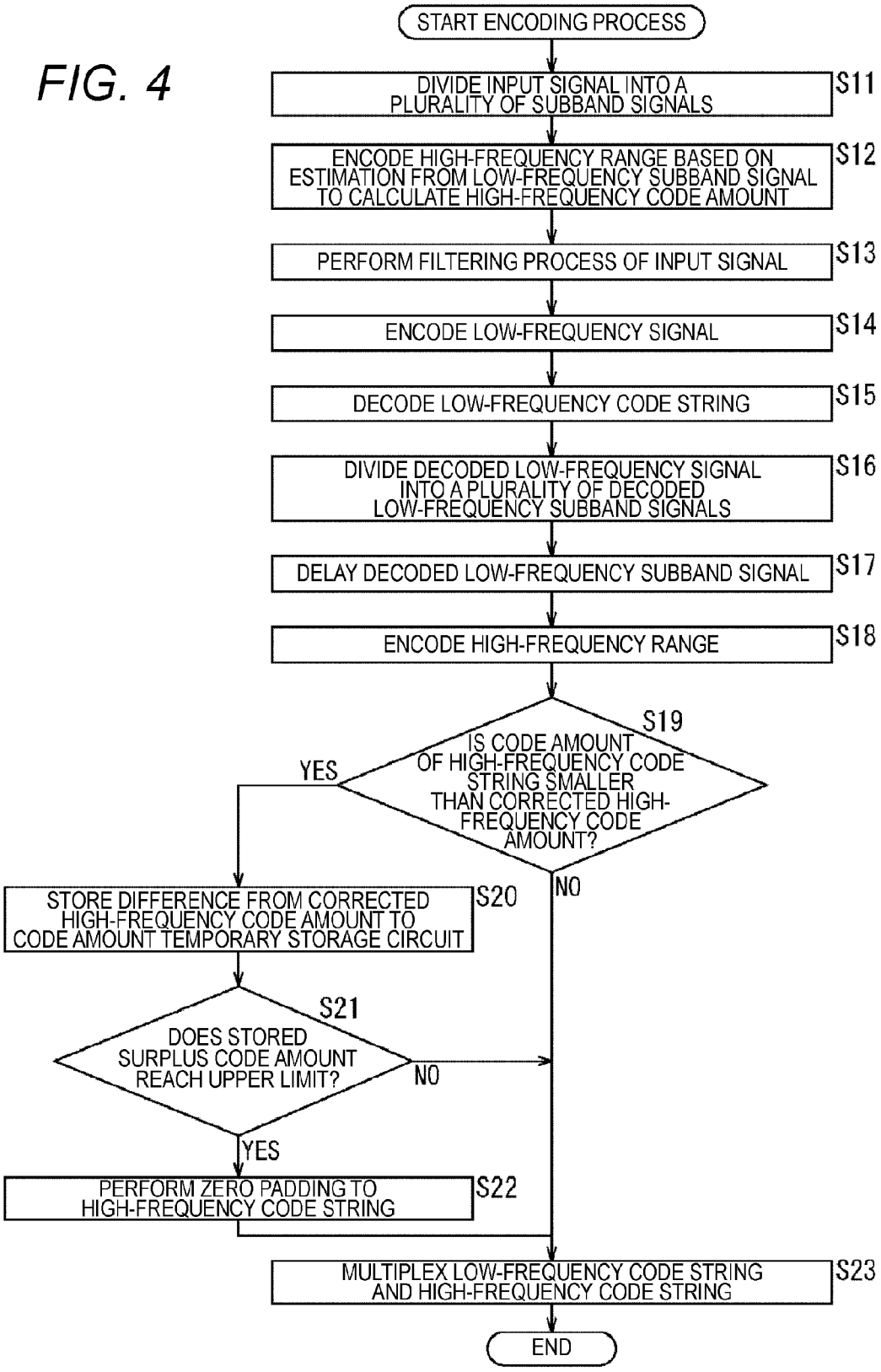
FIG. 4 is a flowchart illustrating an encoding process.

Next, operation of the encoding device 11 is described. When the encoding device 11 is supplied with the input signal and instructed to encode the input signal, the encoding device 11 performs an encoding process to encode the input signal. The encoding process by the encoding device 11 is hereinafter described with reference to a flowchart in FIG. 4.

At step S11, the subband dividing circuit 21 equally divides the supplied input signal into a plurality of subband signals having a predetermined bandwidth. The subband signals in a specific range on the low-frequency side out of the subband signals herein obtained are made the low-frequency subband signals and the subband signals in a specific range on the high-frequency side are made the high-frequency subband signals.

The subband dividing circuit 21 supplies the low-frequency subband signal obtained by the subband division to the first high-frequency encoding circuit 22 and supplies the high-frequency subband signal to the first high-frequency encoding circuit 22 and the delay circuit 29.

For example, the range of the subbands of the high-frequency subband signals is set on the encoding device 11 side according to a property, a bit rate and the like of the input signal. Also, the range of the subbands of the low-frequency subband signals is the frequency band having a certain number of subbands in which the subband on a lower-frequency side by one than the lowest-frequency subband of the high-frequency subband signal is the highest-frequency subband of the low-frequency subband signal. In this manner, the range of the subbands covered by the low-frequency subband signals and the high-frequency subband signals is the same in the encoding device 11 and the decoding device.

At step S12, the first high-frequency encoding circuit 22 encodes the high-frequency range based on estimation from the low-frequency subband signal supplied from the subband dividing circuit 21 to calculate the high-frequency code amount and supplies the high-frequency code amount to the low-frequency encoding circuit 24 and the delay circuit 28.

For example, the first high-frequency encoding circuit 22 calculates the power of the low-frequency subband signal (hereinafter, referred to as low-frequency subband power) of each subband supplied from the subband dividing circuit 21 as the feature amount. The first high-frequency encoding circuit 22 also calculates an estimate value of the power of the high-frequency subband signal of each high-frequency subband (hereinafter, referred to as pseudo high-frequency subband power) from the low-frequency subband power and the estimation coefficient for each of a plurality of estimation coefficients. Specifically, the low-frequency subband power of each of the subbands are linearly combined using the estimation coefficient for each subband and the pseudo high-frequency subband power of a predetermined subband is obtained.

Then, the first high-frequency encoding circuit 22 compares the pseudo high-frequency subband power to actual power of the high-frequency subband signal (hereinafter, referred to as high-frequency subband power) and selects the estimation coefficient with which the high-frequency range of the input signal may be estimated with the highest degree of accuracy out of a plurality of estimation coefficients. The first high-frequency encoding circuit 22 makes a code amount of a coefficient index which specifies the selected estimation coefficient, the code amount of the encoded high-frequency component, that is to say, the high-frequency code amount.

Meanwhile, various encoding methods may be used as long as they are the encoding methods of encoding the high-frequency range by using the low-frequency signal. Also, in a high-frequency encoding process at step S12, the encoding is not necessarily actually performed if the high-frequency code amount may be calculated. Further, when it is wanted to reduce a calculation processing amount, a configuration in which a part of the process is omitted and an estimate value of the high-frequency code amount is obtained is also possible.

At step S13, the low-pass filter 23 performs a filtering process of the supplied input signal, thereby allowing a low-frequency component of the input signal to pass to generate the low-frequency signal and outputs the same to the low-frequency encoding circuit 24. Although an optional frequency may be set as a cutoff frequency of the filter used in the filtering process, in this embodiment, the cutoff frequency is set corresponding to an upper-end frequency of the above-described low-frequency subband signal.

At step S14, the low-frequency encoding circuit 24 encodes the low-frequency signal from the low-pass filter 23 with the code amount obtained by subtracting the high-frequency code amount supplied from the first high-frequency encoding circuit 22 from the code amount available in an entire processing frame determined in advance. The low-frequency encoding circuit 24 outputs the low-frequency code string obtained by the encoding of the low-frequency signal to the low-frequency decoding circuit 25 and the delay circuit 33.

At step S15, the low-frequency decoding circuit 25 decodes the low-frequency code string supplied from the low-frequency encoding circuit 24 and outputs the decoded low-frequency signal thereby obtained to the subband dividing circuit 26. Meanwhile, the encoding device 11 may use various encoding systems for encoding and decoding the low-frequency signal and it is possible to adopt ACELP (algebraic code excited linear prediction), AAC (advanced audio coding) and the like, for example.

At step S16, the subband dividing circuit 26 divides the decoded low-frequency signal supplied from the low-frequency decoding circuit 25 into the decoded low-frequency subband signals of a plurality of subbands and outputs the same to the delay circuit 27. Lower-end and upper-end frequencies of each subband in this subband division are identical to those of the subband division performed by the subband dividing circuit 21 at step S11. That is to say, the frequency bands of the subbands of the decoded low-frequency subband signals are the same as those of the subbands of the low-frequency subband signals.

At step S17, the delay circuit 27 delays the decoded low-frequency subband signal supplied from the subband dividing circuit 26 by a specific time sample to supply to the second high-frequency encoding circuit 30.

A delay amount in the delay circuit 27 is set for synchronization of the low-frequency signal, the high-frequency signal, the high-frequency code amount, and the low-frequency code string, and it is required to set an appropriate value according to the encoding system of the low-frequency range and the high-frequency range. Of course, there might be a case in which the delay amount of each delay circuit is set to 0 according to the configuration of the encoding system. Other delay circuits 28, 29 and 33 have a function equivalent to that of the delay circuit 27, so that the description thereof is herein omitted.

At step S18, the second high-frequency encoding circuit 30 encodes the estimation coefficient of the power of the high-frequency subband signal supplied from the delay circuit 29 based on the feature amount obtained from the decoded low-frequency subband signal output from the delay circuit 27 such that the code amount is not larger than the high-frequency code amount supplied from the delay circuit 28.

For example, the second high-frequency encoding circuit 30 adds the surplus code amount stored in the code amount temporary storage circuit 32 to the high-frequency code amount supplied from the delay circuit 28 to calculate a high-frequency code amount which is corrected (hereinafter referred to as a corrected high-frequency code amount). At that time, when the surplus code amount is not smaller than an upper-limit correction amount determined in advance of the high-frequency code amount, a code amount obtained by adding the upper-limit correction amount to the high-frequency code amount is made the corrected high-frequency code amount.

When the high-frequency code amount is corrected, the code amount adjusting circuit 31 supplies information indicating the surplus code amount or the upper-limit correction amount to the second high-frequency encoding circuit 30 based on the surplus code amount stored in the code amount temporary storage circuit 32. The code amount adjusting circuit 31 also updates the surplus code amount of the code amount temporary storage circuit 32. For example, when the information indicating the upper-limit correction amount is supplied to the second high-frequency encoding circuit 30, the code amount adjusting circuit 31 makes a code amount obtained by subtracting the upper-limit correction amount from the surplus code amount an updated surplus code amount.

Further, the second high-frequency encoding circuit 30 encodes the high-frequency component of the audio signal of the frame to be processed based on the high-frequency subband signal and the decoded low-frequency subband signal such that the code amount of the high-frequency code string is not larger than the corrected high-frequency code amount.

For example, the second high-frequency encoding circuit 30 divides the frame to be processed into several sections and performs the process similar to the process at step S12, thereby selecting the estimation coefficient of each section.

That is to say, the second high-frequency encoding circuit 30 obtains the decoded low-frequency subband power from the decoded low-frequency subband signal and calculates the pseudo high-frequency subband power from the decoded low-frequency subband power and the estimation coefficient for each estimation coefficient. Then, the second high-frequency encoding circuit 30 compares the pseudo high-frequency subband power to the high-frequency subband power of the high-frequency subband signal and selects the estimation coefficient with which the high-frequency range of the input signal may be estimated with the highest degree of accuracy. The second high-frequency encoding circuit 30 makes a code string formed of the coefficient index indicating the estimation coefficient of each section composing the frame to be processed the high-frequency code string.

Herein, the code amount of the high-frequency code string is adjusted by changing the number of sections composing the frame to be processed, for example. When the same estimation coefficient is selected in continuous sections, it is also possible to adjust the code amount of the high-frequency code string by making information formed of information to specify the sections and the coefficient index of selected one estimation coefficient the code string composing the high-frequency code string.

Meanwhile, it is also possible that the high-frequency code amount is not corrected. In such a case, the high-frequency range is encoded such that the code amount of the high-frequency code string is not larger than the high-frequency code amount output from the delay circuit 28.

In the encoding system at step S18, as in the encoding system of the process at step S12, various encoding methods may be used as long as they are the encoding methods of encoding the high-frequency range using the low-frequency signal; however, it is required that this is at least based on the same encoding standard as that of the encoding system at step S12. The encoding process at step S18 is clearly different from the encoding process at step S12 in that, first, it is required to encode such that the code amount is not larger than the high-frequency code amount calculated at step S12, and second, the low-frequency signal required for encoding the high-frequency range is the decoded low-frequency signal (decoded low-frequency subband signal).

In this manner, by provisionally encoding the high-frequency range by the first high-frequency encoding circuit 22 to determine the high-frequency code amount and actually encoding the high-frequency range such that the code amount of the high-frequency code string is not larger than the code amount determined by the high-frequency code amount, it is possible to fix the code amount of the high-frequency code string before the encoding of the high-frequency range is performed. According to this, it is possible to obtain the code amount assigned to the low-frequency frequency code string, so that it is possible immediately encode the low-frequency signal and more efficiently encode the input signal.

At step S19, the second high-frequency encoding circuit 30 determines whether the code amount of the high-frequency code string obtained by the encoding is smaller than the corrected high-frequency code amount.

At step S19, when it is determined that the code amount is not smaller than the corrected high-frequency code amount, that is to say, when the code amount of the high-frequency code string conforms to the corrected high-frequency code amount, the surplus code is not generated, so that the process shifts to step S23. At that time, the second high-frequency encoding circuit 30 supplies the high-frequency code string obtained by encoding the high-frequency range to the multiplexing circuit 34.

On the other hand, when it is determined that the code amount is smaller than the corrected high-frequency code amount at step S19, the code amount adjusting circuit 31 stores a difference between the code amount of the high-frequency code string and the corrected high-frequency code amount in the code amount temporary storage circuit 32 at step S20. That is to say, the code amount being the difference between the code amount of the high-frequency code string and the corrected high-frequency code amount is added to the surplus code amount stored in the code amount temporary storage circuit 32 and the surplus code amount is updated.

Such code amount temporary storage circuit 32 is also used in the AAC under the name of a bit resolver for adjusting the code amount between the processing frames. Meanwhile, although the encoding device 11 is configured such that the surplus code amount is used for the high-frequency encoding, this may also be commonly used when there is a circuit having the similar function in the encoding system of the low-frequency signal. That is to say, the surplus code amount may be used only for adjusting the code amount of any one of the high-frequency code string and the low-frequency code string or may be used for adjusting the code amount of both of them.

At step S21, the code amount adjusting circuit 31 determines whether the surplus code amount stored in the code amount temporary storage circuit 32 reaches an upper limit determined in advance.

For example, in the code amount temporary storage circuit 32, an upper limit of the code amount which may be made the surplus code amount (hereinafter, referred to as an upper-limit code amount) is determined in advance. The code amount adjusting circuit 31 determines that the surplus code amount reaches the upper limit at step S21 when the surplus code amount reaches the upper-limit code amount at the time of the storage of the difference between the code amount of the high-frequency code string and the corrected high-frequency code amount in the code amount temporary storage circuit 32 started at step S20.

At step S21, when it is determined that the surplus code amount does not reach the upper limit, an entire difference between the code amount of the high-frequency code string and the corrected high-frequency code amount is added to the surplus code amount and the surplus code amount is updated. Thereafter, the second high-frequency encoding circuit 30 supplies the high-frequency code string obtained by encoding the high-frequency range to the multiplexing circuit 34 and the process shifts to step S23.

On the other hand, when it is determined that the surplus code amount reaches the upper limit at step S21, the second high-frequency encoding circuit 30 performs zero padding to the high-frequency code string at step S22.

While the difference between the code amount of the high-frequency code string and the corrected high-frequency code amount is added to the surplus code amount, when the surplus code amount reaches the upper-limit code amount, an unprocessed code amount, which is not yet added to the surplus code amount, out of the difference between the code amount of the high-frequency code string and the corrected high-frequency code amount remains. The unprocessed code amount cannot be added to the surplus code amount, so that the second high-frequency encoding circuit 30 adds a code "0" at the end of the high-frequency code string by an amount of the unprocessed code amount such that the unprocessed code amount is apparently used for generating the high-frequency code string. Meanwhile, at the time of decoding, the code "0" added at the end of the high-frequency code string is not used for decoding the input signal.

When the second high-frequency encoding circuit 30 performs the zero padding to add the code "0" at the end of the high-frequency code string, this supplies the high-frequency code string after the zero padding to the multiplexing circuit 34 and the process shifts to step S23.

When it is determined that the code amount is not smaller than the corrected high-frequency code amount at step S19, when it is determined that the surplus code amount does not reach the upper limit at step S21, or when the zero padding is performed at step S22, the process at step S23 is performed.

That is to say, at step S23, the multiplexing circuit 34 multiplexes the low-frequency code string from the delay circuit 33 and the high-frequency code string from the second high-frequency encoding circuit 30 to generate the output code string and outputs the output code string. At that time, the multiplexing circuit 34 also multiplexes indexes indicating upper-end and lower-end subbands on the low-frequency side of the input signal together with the low-frequency code string and the high-frequency code string. When the output code string is output in this manner, the encoding process is finished.

As described above, the encoding device 11 obtains the high-frequency code amount to encode the low-frequency signal with the code amount determined by the high-frequency code amount and encodes the high-frequency component based on the decoded low-frequency signal obtained by decoding the low-frequency code string and the high-frequency code amount.

In this manner, by provisionally encoding the high-frequency range to determine the high-frequency code amount and actually encoding the high-frequency range such that the code amount of the high-frequency code string is not larger than the code amount determined by the high-frequency code amount, it is possible to fix the code amount of the high-frequency code string before the high-frequency range is encoded. According to this, it is possible to obtain the code amount assigned to the low-frequency code string and immediately encode the low-frequency signal. Therefore, it is possible to efficiently encode so as to avoid a complicated configuration of the encoding device 11 and avoid increase in calculation amount. It is also possible to select a more appropriate estimation coefficient by encoding the high-frequency range using the decoded low-frequency signal, thereby improving the quality of the audio.

Configuration Example of Decoding Device

Figure 5:
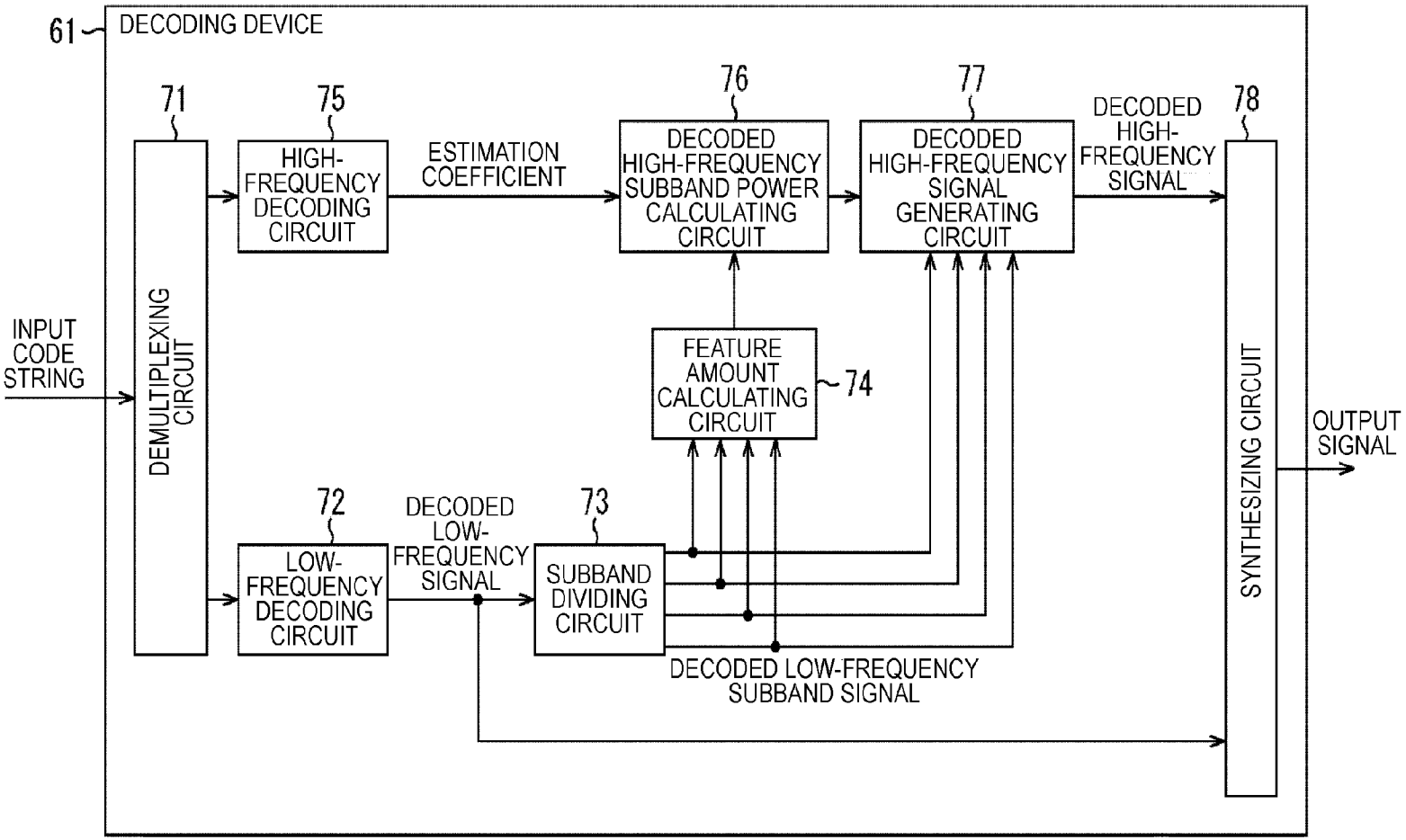
FIG. 5 is a view illustrating a configuration example of a decoding device.

Next, the decoding device to which the output code string output from the encoding device 11 is input as the input code string, the decoding device which decodes the input code string is described. The decoding device is configured as illustrated in FIG. 5, for example.

A decoding device 61 is composed of a demultiplexing circuit 71, a low-frequency decoding circuit 72, a subband dividing circuit 73, a feature amount calculating circuit 74, a high-frequency decoding circuit 75, a decoded high-frequency subband power calculating circuit 76, a decoded high-frequency signal generating circuit 77, and a synthesizing circuit 78.

The demultiplexing circuit 71 demultiplexes the input code string into the high-frequency code string and the low-frequency code string and supplies the low-frequency code string and the high-frequency code string to the low-frequency decoding circuit 72 and the high-frequency decoding circuit 75, respectively.

The low-frequency decoding circuit 72 decodes the low-frequency code string from the demultiplexing circuit 71 and supplies the decoded low-frequency signal obtained as a result to the subband dividing circuit 73 and the synthesizing circuit 78.

The subband dividing circuit 73 equally divides the decoded low-frequency signal from the low-frequency decoding circuit 72 into a plurality of subband signals having a predetermined band width and supplies the obtained subband signal (decoded low-frequency subband signal) to the feature amount calculating circuit 74 and the decoded high-frequency signal generating circuit 77.

The feature amount calculating circuit 74 calculates the feature amount using the decoded low-frequency subband signal from the subband dividing circuit 73 and supplies the same to the decoded high-frequency subband power calculating circuit 76.

The high-frequency decoding circuit 75 which associates the coefficient index and the estimation coefficient with each other to record, decodes the high-frequency code string from the demultiplexing circuit 71 and supplies the estimation coefficient specified by the coefficient index obtained as a result to the decoded high-frequency subband power calculating circuit 76.

The decoded high-frequency subband power calculating circuit 76 calculates decoded high-frequency subband power being an estimate value of the high-frequency subband power of each subband on the high-frequency side of the input signal based on the feature amount from the feature amount calculating circuit 74 and the estimation coefficient from the high-frequency decoding circuit 75 and supplies the same to the decoded high-frequency signal generating circuit 77.

The decoded high-frequency signal generating circuit 77 generates a decoded high-frequency signal based on the decoded low-frequency subband signal from the subband dividing circuit 73 and the decoded high-frequency subband power from the decoded high-frequency subband power calculating circuit 76 and supplies the same to the synthesizing circuit 78. The synthesizing circuit 78 synthesizes the decoded low-frequency signal from the low-frequency decoding circuit 72 and the decoded high-frequency signal from the decoded high-frequency signal generating circuit 77 and outputs the same as an output signal.

Description of Decoding Process

Figure 6:
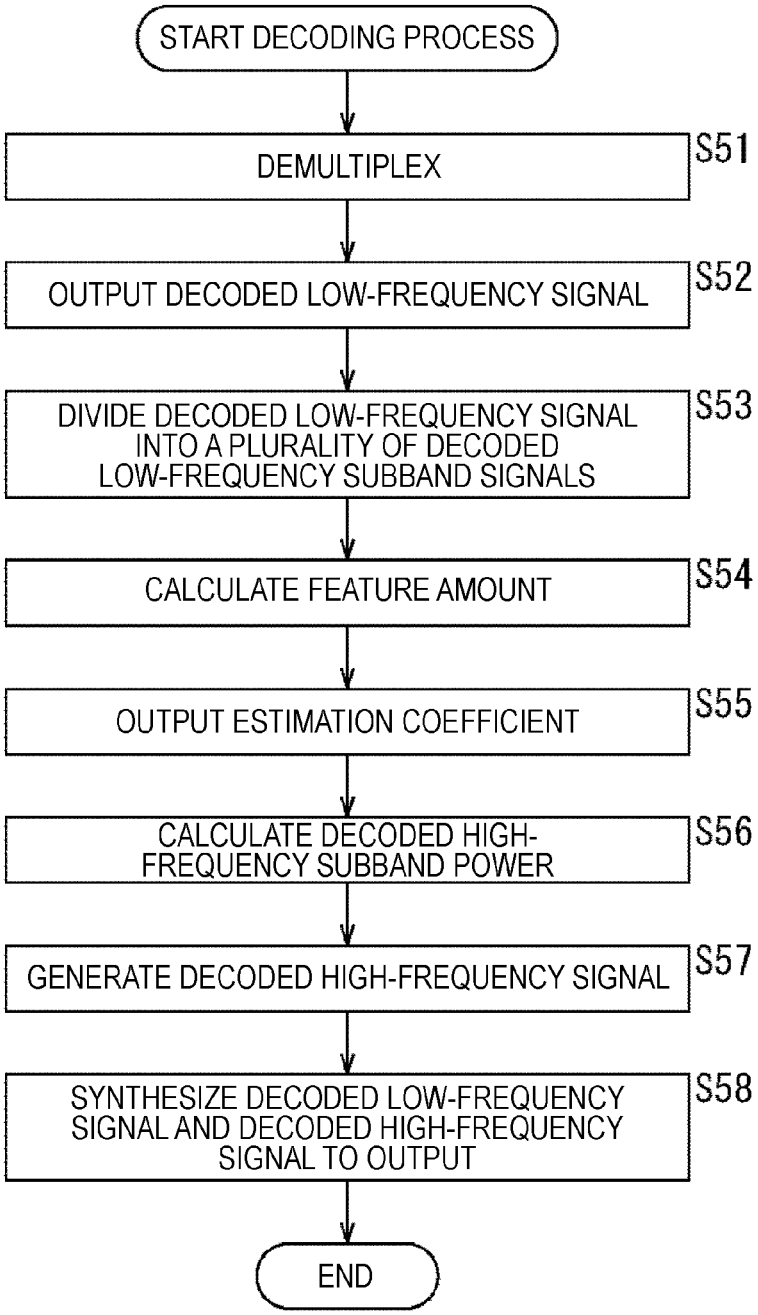
FIG. 6 is a flowchart illustrating a decoding process.

Next, operation of the decoding device 61 is described. When the output code string is supplied from the encoding device 11, the decoding device 61 makes the output code string the input code string and performs a decoding process thereof to output the output signal. Hereinafter, the decoding process by the decoding device 61 is described with reference to a flowchart in FIG. 6.

At step S51, the demultiplexing circuit 71 demultiplexes the input code string into the high-frequency code string and the low-frequency code string and supplies the low-frequency code string and the high-frequency code string to the low-frequency decoding circuit 72 and the high-frequency decoding circuit 75, respectively. At that time, the demultiplexing circuit 71 supplies the indexes indicating the upper-end and lower-end subbands on the low-frequency side of the input signal obtained by demultiplexing as needed to the subband dividing circuit 73 through the low-frequency decoding circuit 72. According to this, the subband dividing circuit 73 may specify the frequency band suitable for each low-frequency subband.

At step S52, the low-frequency decoding circuit 72 decodes the low-frequency code string from the demultiplexing circuit 71 and supplies the decoded low-frequency signal obtained as a result to the subband dividing circuit 73 and the synthesizing circuit 78.

At step S53, the subband dividing circuit 73 divides the decoded low-frequency signal from the low-frequency decoding circuit 72 into a plurality of decoded low-frequency subband signals using the index from the demultiplexing circuit 71 as needed and supplies the same to the feature amount calculating circuit 74 and the decoded high-frequency signal generating circuit 77.

At step S54, the feature amount calculating circuit 74 calculates the feature amount using the decoded low-frequency subband signal from the subband dividing circuit 73 and supplies the same to the decoded high-frequency subband power calculating circuit 76. For example, the decoded low-frequency subband power being the power of the decoded low-frequency subband signal of each subband is calculated as the feature amount.

At step S55, the high-frequency decoding circuit 75 decodes the high-frequency code string from the demultiplexing circuit 71 and outputs the estimation coefficient specified by the coefficient index obtained as a result to the decoded high-frequency subband power calculating circuit 76.

At step S56, the decoded high-frequency subband power calculating circuit 76 calculates the decoded high-frequency subband power of each high-frequency subband based on the feature amount from the feature amount calculating circuit 74 and the estimation coefficient from the high-frequency decoding circuit 75 and supplies the same to the decoded high-frequency signal generating circuit 77.

For example, the decoded low-frequency subband power of each of the subbands as the feature amounts are linearly combined using the estimation coefficient for each subband to obtain the decoded high-frequency subband power of a predetermined subband.

At step S57, the decoded high-frequency signal generating circuit 77 generates the decoded high-frequency signal based on the decoded low-frequency subband signal from the subband dividing circuit 73 and the decoded high-frequency subband power from the decoded high-frequency subband power calculating circuit 76 and supplies the same to the synthesizing circuit 78.

At step S58, the synthesizing circuit 78 synthesizes the decoded low-frequency signal from the low-frequency decoding circuit 72 and the decoded high-frequency signal from the decoded high-frequency signal generating circuit 77 and outputs the same as the output signal. The output signal is the audio signal formed of the high-frequency component predicted using the estimation coefficient and the low-frequency component obtained by the decoding.

When the output signal is generated to be output, the decoding process is finished. The decoding device 61 demultiplexes the input code string in this manner, estimates the high-frequency component using the estimation coefficient obtained from the high-frequency code string, and generates the output signal. By estimating the high-frequency component using the estimation coefficient in this manner, it is possible to more efficiently decode and improve the quality of the audio obtained by the decoding.

Variation

Configuration Example of Encoding Device

Meanwhile, although the case in which various signals and pieces of information such as the high-frequency code amount and the high-frequency subband signal are delayed as needed in the encoding device 11 is described above, when it is not necessarily required to delay, a configuration in which an encoding device is not provided with a delay circuit is also possible.

Figure 7:
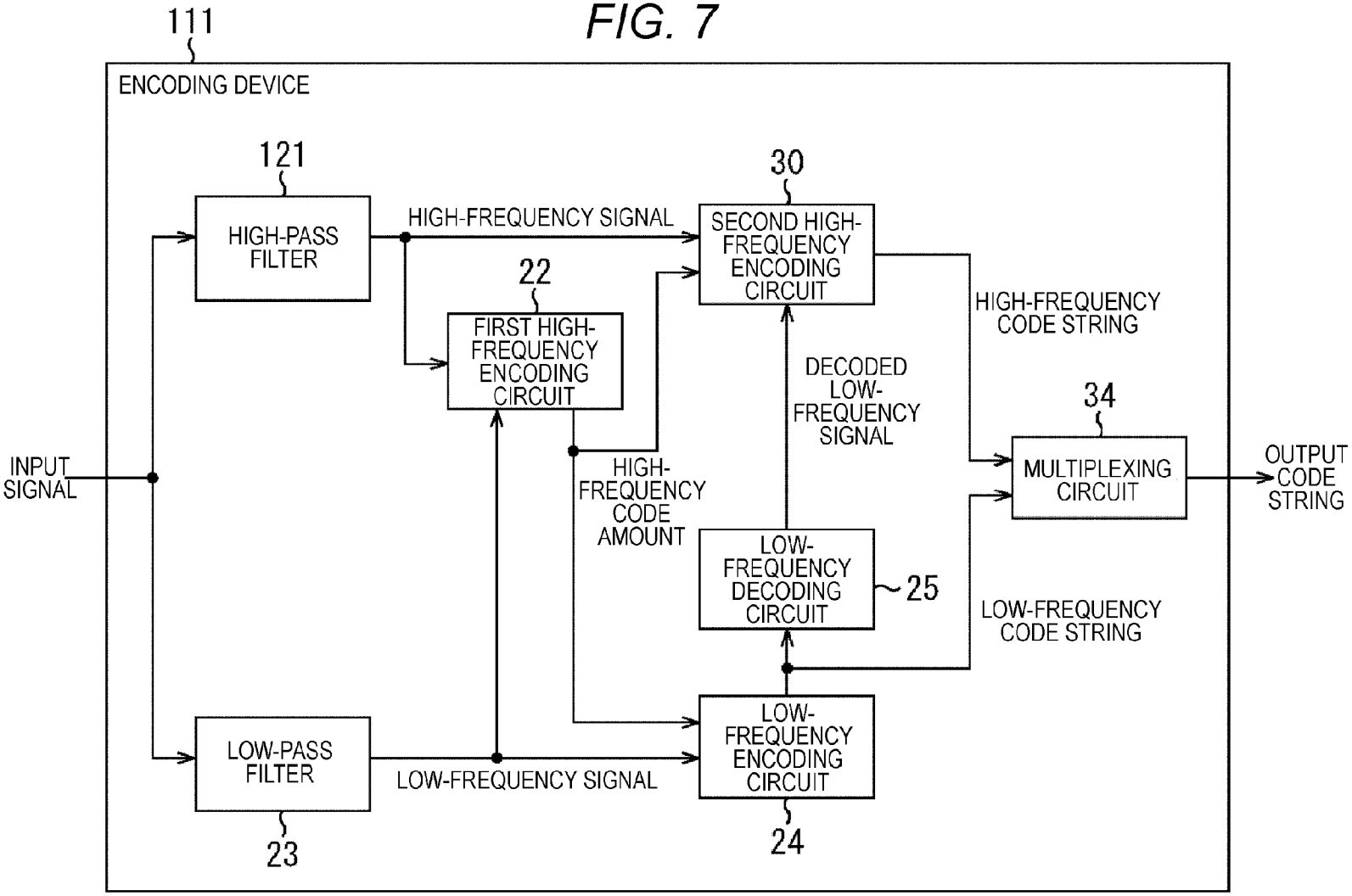
FIG. 7 is a view illustrating another configuration example of the encoding device.

In such a case, the encoding device is configured as illustrated in FIG. 7, for example. Meanwhile, in FIG. 7, the same reference sign is assigned to a part corresponding to that in FIG. 1 and description thereof is appropriately omitted.

An encoding device 111 in FIG. 7 is composed of a high-pass filter 121, a first high-frequency encoding circuit 22, a low-pass filter 23, a low-frequency encoding circuit 24, a low-frequency decoding circuit 25, a second high-frequency encoding circuit 30, and a multiplexing circuit 34.

The high-pass filter 121 performs a filtering process of a supplied input signal to extract a high-frequency signal being a high-frequency component from the input signal and supplies the same to the first high-frequency encoding circuit 22 and the second high-frequency encoding circuit 30. The low-pass filter 23 performs the filtering process of the supplied input signal to extract a low-frequency signal being a low-frequency component from the input signal and supplies the same to the first high-frequency encoding circuit 22 and the low-frequency encoding circuit 24.

The first high-frequency encoding circuit 22 encodes a high-frequency range of the input signal based on the high-frequency signal from the high-pass filter 121 and the low-frequency signal from the low-pass filter 23 and supplies a high-frequency code amount thereby obtained to the low-frequency encoding circuit 24 and the second high-frequency encoding circuit 30.

The low-frequency encoding circuit 24 encodes the low-frequency signal from the low-pass filter 23 with a code amount obtained by subtracting the high-frequency code amount from the first high-frequency encoding circuit 22 from a code amount available in an entire processing frame and supplies a low-frequency code string thereby obtained to the low-frequency decoding circuit 25 and the multiplexing circuit 34. The low-frequency decoding circuit 25 decodes the low-frequency code string from the low-frequency encoding circuit 24 and supplies a decoded low-frequency signal obtained as a result to the second high-frequency encoding circuit 30.

The second high-frequency encoding circuit 30 encodes the high-frequency component of the input signal based on the high-frequency signal from the high-pass filter 121 and the decoded low-frequency signal from the low-frequency decoding circuit 25 such that the code amount is not larger than the code amount determined by the high-frequency code amount from the first high-frequency encoding circuit 22. The second high-frequency encoding circuit 30 supplies the high-frequency code string obtained by the encoding of the high-frequency range to the multiplexing circuit 34. The multiplexing circuit 34 multiplexes the low-frequency code string from the low-frequency encoding circuit 24 and the high-frequency code string from the second high-frequency encoding circuit 30 and outputs the output code string obtained as a result.

The above-described series of processes may be executed by hardware or may be executed by software. When a series of processes is executed by the software, a program which composes the software, is installed from a program recording medium on a computer embedded in dedicated hardware or a general-purpose personal computer, for example, capable of executing various functions with various programs installed.

Figure 8:
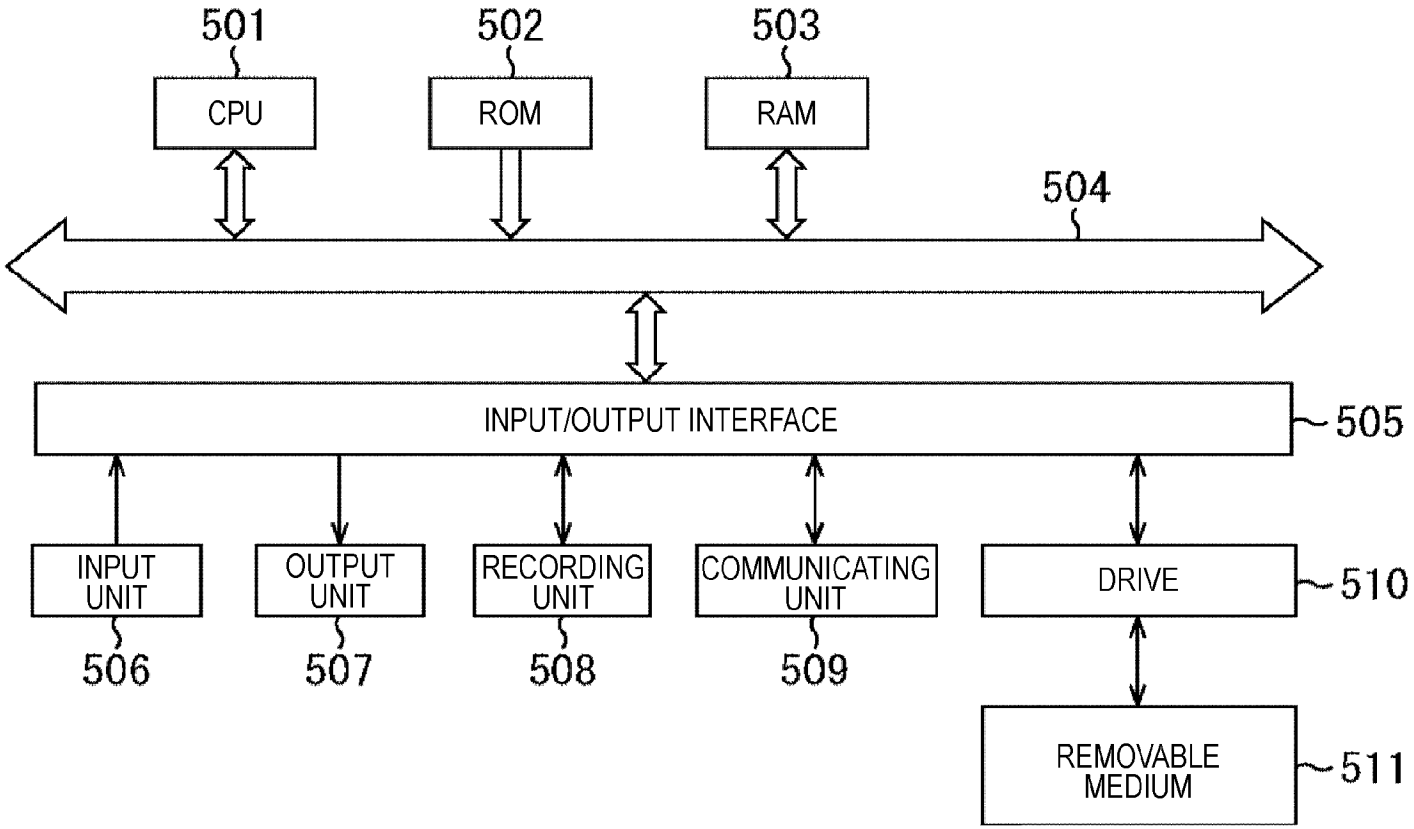
FIG. 8 is a view illustrating a configuration example of a computer.

FIG. 8 is a block diagram illustrating a configuration example of the hardware of the computer which executes the above-described series of processes by the program.

In this computer, a CPU (central processing unit) 501, a ROM (read only memory) 502, and a RAM (random access memory) 503 are connected to one another through a bus 504.

An input/output interface 505 is further connected to the bus 504. An input unit 506 composed of a keyboard, a mouse, a microphone and the like, an output unit 507 composed of a display, a speaker and the like, a recording unit 508 composed of a hard disk, a nonvolatile memory and the like, a communicating unit 509 composed of a network interface and the like, and a drive 510 which drives a removable medium 511 such as a magnetic disk, an optical disk, a magnetooptical disk, or a semiconductor memory are connected to the input/output interface 505.

In the computer configured as described above, the CPU 501 loads the program recorded in the recording unit 508, for example, on the RAM 503 through the input/output interface 505 and the bus 504 to execute, for example, and according to this, the above-described series of processes is performed.

The program executed by the computer (CPU 501) is provided in a state of being recorded on the removable medium 511 which is a packaged medium formed of the magnetic disk (including a flexible disk), the optical disk (CD-ROM (compact disc-read only memory), a DVD (digital versatile disc) and the like), the magnetooptical disk, or the semiconductor memory, for example, or through a wired or wireless transmission medium such as a local area network, the Internet, and digital satellite broadcasting.

The program may be installed on the recording unit 508 through the input/output interface 505 by mounting of the removable medium 511 on the drive 510. Also, the program may be received by the communicating unit 509 through the wired or wireless transmission medium to be installed on the recording unit 508. In addition, the program may be installed in advance on the ROM 502 and the recording unit 508.

Meanwhile, the program executed by the computer may be the program whose process is performed in chronological order in the order described in this specification or may be the program whose process is performed in parallel or at required timing such as when there is a call.

The embodiment of this technology is not limited to the above-described embodiment and various modifications may be made without departing from the scope of this technology.

REFERENCE SIGNS LIST

11 encoding device, 22 first high-frequency encoding circuit, 24 low-frequency encoding circuit, 25 low-frequency decoding circuit, 30 second high-frequency encoding circuit, 31 code amount adjusting circuit, 32 code amount temporary storage circuit, 34 multiplexing circuit

The invention claimed is:

1. An encoding device, comprising:

a first high-frequency encoding circuit which calculates a high-frequency code amount being a code amount of a high-frequency code string for obtaining a high-frequency component based on a low-frequency component and the high-frequency component of an input signal;

a low-frequency encoding circuit which encodes the low-frequency component of the input signal based on the high-frequency code amount calculated by the first high-frequency encoding circuit to generate a low-frequency code string;

a low-frequency decoding circuit which decodes the low-frequency code string;

a second high-frequency encoding circuit which generates the high-frequency code string based on a decoded low-frequency component obtained by decoding the low-frequency code string and the high-frequency component such that the code amount of the high-frequency code string is not larger than the high-frequency code amount;

a multiplexing circuit which multiplexes the low-frequency code string and the high-frequency code string to generate an output code string; and a delay circuit which delays the high-frequency code amount, the decoded low-frequency component, and the high-frequency component input to the second high-frequency encoding circuit.

2. The encoding device according to claim 1, wherein the first high-frequency encoding circuit calculates the high-frequency code amount based on low-frequency subband signals of a plurality of subbands composing the low-frequency component and high-frequency subband signals of a plurality of subbands composing the high-frequency component, and the second high-frequency encoding circuit generates the high-frequency code string based on decoded low-frequency subband signals of a plurality of subbands composing the decoded low-frequency component and the high-frequency subband signals.

3. The encoding device according to claim 1, further comprising:

a code amount adjusting circuit which, when the code amount of the high-frequency code string obtained by the second high-frequency encoding circuit is smaller than the high-frequency code amount, makes a difference between the code amount of the high-frequency code string and the high-frequency code amount a surplus code amount capable of being used in next and subsequent processes and controls storage of the surplus code amount.

4. The encoding device according to claim 3, wherein the surplus code amount is used for adjusting the code amount of at least any of the high-frequency code string and the low-frequency code string.

5. An encoding method comprising:

calculating a high-frequency code amount being a code amount of a high-frequency code string for obtaining a high-frequency component based on a low-frequency component and the high-frequency component of an input signal;

encoding the low-frequency component of the input signal based on the high-frequency code amount to generate a low-frequency code string;

decoding the low-frequency code string;

delaying the high-frequency code amount, a decoded low-frequency component obtained by decoding the low-frequency code string and the high-string is not larger than the high-frequency code amount, and the high-frequency component;

generating the high-frequency code string based on the decoded low-frequency component and multiplexing the low-frequency code string and the high-frequency code string to generate an output code string.

6. A non-transitory computer readable storage device encoded with instructions that, when executed by at least one processor, cause the at least one processor to perform a method comprising acts of:

calculating a high-frequency code amount being a code amount of a high-frequency code string for obtaining a high-frequency component based on a low-frequency component and the high-frequency component of an input signal;

encoding the low-frequency component of the input signal based on the high-frequency code amount to generate a low-frequency code string;

decoding the low-frequency code string;

delaying the high-frequency code amount, a decoded low-frequency component obtained by decoding the low-frequency code string and the high-frequency component such that the code amount of the high-frequency code string is not larger than the high-frequency code amount and the high-frequency component;

generating the high-frequency code string based on the decoded low-frequency component; and multiplexing the low-frequency code string and the high-frequency code string to generate an output code string.

* * * * *